US010569439B2

(12) United States Patent
Broeker

(10) Patent No.: US 10,569,439 B2
(45) Date of Patent: Feb. 25, 2020

(54) DEVICE FOR PROCESSING OF MATERIALS BY CUTTING AND CUTTING UNIT WITH OSCILLATING CUTTING KNIFE AND VARIABLE CUTTING ANGLE OF INCLINATION

(71) Applicant: Guenter Broeker, Halstenbek (DE)

(72) Inventor: Guenter Broeker, Halstenbek (DE)

( * ) Notice: Subject to any disclaimer, the term of this patent is extended or adjusted under 35 U.S.C. 154(b) by 159 days.

(21) Appl. No.: 15/633,471

(22) Filed: Jun. 26, 2017

(65) Prior Publication Data

US 2017/0305027 A1 Oct. 26, 2017

Related U.S. Application Data

(62) Division of application No. 14/075,797, filed on Nov. 8, 2013, now abandoned.

(30) Foreign Application Priority Data

Jun. 3, 2013 (DE) ..... 10 2013 009 251

(51) Int. Cl.
*B26D 7/01* (2006.01)
*B26F 1/38* (2006.01)
*B26D 7/26* (2006.01)

(52) U.S. Cl.
CPC ..... *B26D 7/015* (2013.01); *B26D 7/2628* (2013.01); *B26F 1/3806* (2013.01);
(Continued)

(58) Field of Classification Search
CPC ..... B26D 7/015; B26F 1/3806; B26F 1/3813
See application file for complete search history.

(56) References Cited

U.S. PATENT DOCUMENTS 1,955,350 A 4/1934 Field
5,150,639 A * 9/1992 Hamamura ..... B26F 1/3813 156/267

(Continued)

FOREIGN PATENT DOCUMENTS

DE 19810333 9/1999
DE 112006003596 11/2008

(Continued)

OTHER PUBLICATIONS

G3 Digital Cutter, Technissche Ubersicht, Oct. 2012, ZUND Swiss Cutting Systems, German Language, 6 pages.

(Continued)

*Primary Examiner* — Kenneth E Peterson
*Assistant Examiner* — Liang Dong
(74) *Attorney, Agent, or Firm* — Lempia Summerfield Katz LLC

(57) ABSTRACT

A device for the cutting of material on a plane material supporting surface, the device having at least one cutting unit which can be motor-driven in a controlled manner above the material supporting surface in the direction of the X- and Y-axis of a Cartesian coordinate system that is parallel to the material supporting surface, and having an oscillation drive and a cutting knife, wherein the oscillation drive sets the cutting knife into linear oscillations along an oscillation axis that is perpendicular to the advancing direction of the cutting knife. The cutting knife is pivotable around a pivot axis that is parallel to the material supporting surface and is aligned with the rotary axis of a rotary drive shaft of an electric motor of the oscillation drive.

14 Claims, 7 Drawing Sheets

(52) U.S. Cl.
CPC .... *B26F 1/3813* (2013.01); *B26D 2007/2678* (2013.01); *B26F 2001/388* (2013.01); *B26F 2001/3886* (2013.01); *Y10T 83/865* (2015.04)

(56) References Cited

U.S. PATENT DOCUMENTS 5,197,198 A * 3/1993 Onozato ..... B26F 1/3806 33/1 M
6,131,498 A * 10/2000 Gerber ..... B26D 1/10 30/393
6,152,003 A * 11/2000 Jung ..... B26D 7/20 83/74
2009/0084235 A1* 4/2009 Kata ..... B26D 5/005 83/72
2009/0266217 A1* 10/2009 Nonaka ..... B26D 7/2628 83/881
2011/0166693 A1* 7/2011 Nishibashi ..... G05B 19/4103 700/187
2016/0236287 A1* 8/2016 Tanaka ..... B26D 1/04

FOREIGN PATENT DOCUMENTS

DE 102008009843 8/2009
WO WO2010066054 6/2010

OTHER PUBLICATIONS

G3 Digital Cutter, Technical Overview, Oct. 2012, ZUND Swiss Cutting Systems, Englsih Language, 6 pages.
G3 S3 Digital Cutter, Module, Werkzeuge and Anwendungen, May 2012, ZUND Swiss Cutting Systems, German Language, 8 pages.
Kombo SD; The Right Choice for the Finishing in the Graphic Industry, Product Information, Elitron Innovative Producation Methods, Date Unknown, 3 pages.
Zund Digital Cutters, Modules, tools and applications, Oct. 2013, Zund Swiss Cutting Systems, English language, 8 pages.

* cited by examiner

DEVICE FOR PROCESSING OF MATERIALS BY CUTTING AND CUTTING UNIT WITH OSCILLATING CUTTING KNIFE AND VARIABLE CUTTING ANGLE OF INCLINATION

RELATED APPLICATION DATA

This patent is a division of and claims priority benefit of co-pending U.S. application Ser. No. 14/075,797 filed Nov. 8, 2013 and of the same title, and which claimed priority to German national application no. 10 2013 009 251.5 filed Jun. 3, 2013. The entire contents of this prior filed application are hereby incorporated herein by reference.

FIELD OF THE DISCLOSURE

The present invention relates generally to devices for cutting materials, and more particularly to a device for cutting material on a material supporting surface and to a cutting unit with an oscillation drive, a holder for the oscillation drive, and a cutting knife, wherein the oscillation drive sets the cutting knife into linear oscillations along an axis of oscillation that is perpendicular to an advancing direction of the cutting knife.

BACKGROUND

Devices of the type named above are used for the cutting of cuttable material, especially of web-like or sheet-like material, for example, films, cloth, paper, cardboard, foamed material or polystyrene. Such devices are disclosed among others in the pamphlet "Technical Overview of the Digital Cutter G3" of the company Zünd Systemtechnik AG and in the pamphlet "Kombo SD" of the company Eiltron. The material supporting surface of these devices is formed by the plane upper surface of a cutting table, onto which the material to be cut is attached by aspiration using vacuum. Usually the cutting table comprises a motor-driven arch or portal which can be moved in a controlled manner perpendicularly to its longitudinal axis in the direction of the X-axis along the material supporting surface, and a motor-driven carrier on the arch or portal, which can be moved in a controlled manner in the direction of the Y-axis to travel along the arch or portal. On the carrier, one or several holders are attached for replaceable processing units or modules that can be positioned by computer-controlled drive movements of the arch and of the carrier at arbitrary locations above the material on the material supporting surface and which allow arbitrary movement paths across the material. These devices are also called cutting plotters.

As is described in the pamphlet "Kombo SD" of the company Eiltron or in the pamphlet "Modules, Tools and Applications G3 S3 Digital Cutter" of the company Zünd, in addition to milling or marking modules, the processing modules comprise a number of cutting modules or cutting units, which have either fixed cutting knives or oscillating cutting knives and may be provided with a holder for securing them to the carrier.

The cutting modules or cutting units with fixed cutting knives comprise not only those in which the cutting knife is perpendicular to the material support surface but also those in which the cutting knife is inclined in a plane that is perpendicular to its forward moving direction at an angle of 45 degrees, such as the "Passepartout Tool PPT" of the company Zünd, so that the material can be cut at a slant in the direction of movement of the knife, for example, in order to produce a V groove.

The possibility of cutting slanting cuts or V grooves is advantageous, especially in the case of large material thicknesses. However, fairly solid materials, for example, cardboard, cannot be cut with a fixed knife, when the cutting depth exceeds a certain value. Even when the material can still be cut with a fixed knife, the cutting performance is considerably less effective than in the case of cutting units with oscillating cutting knives which are set into oscillation with the aid of an electrical or pneumatic oscillation drive along an axis that is perpendicular to the advancing direction of the cutting knife.

The known electrical oscillation drives are mostly piezoelectric oscillation drives, which have a very small stroke height so that the cutting units equipped with them are not suitable for the cutting of all materials. Cutting units with pneumatic oscillation drives do not provide an exact setting of the cutting depth and require an additional compressed air supply, as a result of which the device becomes more complex and expensive.

Also, to date no cutting units with tangential knives are known with which slanted cuts can be made into the material along a movement path that is curved with respect to the material supporting surface.

SUMMARY

The present disclosure relates to a device for cutting material on a material supporting surface, the device having at least one cutting unit which can be motor-driven in a controlled manner above and across the material supporting surface in the direction of an X-axis and a Y-axis of a Cartesian coordinate system that is parallel to the material supporting surface and which device comprises an oscillation drive and a cutting knife, wherein the oscillation drive sets the cutting knife into linear oscillations having an oscillating axis which is perpendicular to an advancing direction of the cutting knife. Furthermore, the invention relates to a cutting unit comprising an oscillation drive, a holder for the oscillation drive and a cutting knife, wherein the oscillation drive sets the cutting knife into linear oscillations along an axis of oscillation that is perpendicular to an advancing direction of the cutting knife.

Based on the foregoing background, the invention has as its object the improvement of a device and a cutting unit of the type mentioned at the outset so that with the oscillating cutting knife, slanted cuts or V-shaped grooves with a variable angle of inclination with respect to the material supporting surface can be cut into the material.

In the device according to the invention, this object is achieved by the fact that the oscillation drive together with the cutting knife, is pivotable around a pivot axis that is parallel to the material supporting surface in order to alter the angle of inclination of the oscillation axis and thus of the cuts produced in the material with respect to the material supporting surface or in order to set a desired angle of inclination with respect to the material supporting surface. The cutting unit according to the invention is characterized by the fact that the oscillation drive, together with the cutting knife, is pivotable with the respect to the holder around a pivot axis that is perpendicular to the oscillation axis.

The pivot axis of the cutting unit is preferably oriented perpendicularly to the oscillation axis of the cutting knife, so that it intersects the pivot axis at a right angle.

The oscillation drive is preferably an electrical drive, so that an exact cutting depth can be provided and the device does not need an additional compressed air supply, which makes it possible to incorporate the cutting unit even in smaller and more economical devices. Advantageously, the oscillation drive comprises an electrical drive motor with a rotating drive shaft which is connected to a knife holder that carries and guides the cutting knife linearly by means of a cam that converts the rotation of the drive shaft into an oscillating movement of the knife holder. As a result of this, an oscillating movement of the cutting knife is achieved with a stroke height of up to 2 mm, which is more than the stroke height of piezoelectric oscillation drives.

According to a preferred embodiment of the invention, the drive shaft of the oscillation drive is oriented parallel to the supporting surface, wherein its axis of rotation is aligned with the pivot axis. In order to reduce the number of movable parts and thus undesirable vibrations, the drive shaft is advantageously the motor shaft of the electrical drive motor which projects from one side of a motor housing of the drive motor. The motor shaft is supported in the usual manner within the motor housing in two bearings, however, according to a favorable embodiment of the invention, outside the motor housing and beyond the oscillation axis of the cutting knife an additional bearing is provided, in which the free end of the motor shaft is supported rotatably. The additional bearing is expediently removable.

Another preferred embodiment of the device according to the invention provides that the cutting unit is attached to a holder that can be moved in a controlled motor-driven manner in the direction of the X-axis and the Y-axis, wherein the entire cutting unit is secured or suspended replaceably, as expedient, on the carrier.

Since the distance of the tip of the cutting knife from the material supporting surface changes when the oscillation drive with the cutting knife is pivoted around the pivot axis, advantageously the height of the cutting unit with respect to the carrier can be adjusted.

The cutting knife can be fundamentally a drag knife, the cutting edge of which is directed into the advancing direction by frictional forces between the cutting knife and the material. However, preferably, the cutting knife is a tangential knife whose orientation is controlled actively during cutting so that the cutting edge is always positioned in the advancing direction. This control or alignment, which is also called tangential control or tangential feed, is performed according to another preferred embodiment of the invention with the aid of a controlled tangential or rotary drive that is arranged between the oscillation drive and the carrier. With the aid of this tangential or rotary drive the oscillation drive, together with the cutting knife, can be rotated around the oscillation axis of the cutting knife with respect to the carrier. It is thereby possible to cut the material with inclined cuts along curved movement paths.

Preferably, the cutting unit comprises a holder for the oscillation drive in which the latter is supported pivotably, so that, together with the cutting knife, a knife carrier that holds the cutting knife and a guide for the knife carrier, it can be pivoted around the pivot axis with respect to the holder to change the angle of inclination of the oscillation axis with respect to the material supporting surface.

Depending on whether the knife is a drag knife or a tangential knife driven by a tangential or rotary drive, the holder is secured either directly to the carrier or to a drive shaft of the tangential or rotary drive.

Another preferred embodiment of the invention provides that the cutting knife is secured to a linearly guided oscillating knife carrier and that a cam for converting the rotary movement of the drive shaft of the electric motor into an oscillating movement of the cutting knife comprises an eccentric ring and connecting rod drive between the drive shaft and the knife carrier. This eccentric ring and connecting rod drive comprises advantageously an eccentric ring which is fixedly attached to the drive shaft, and a connecting rod the connecting rod foot of which is pivotably hinged or articulated to the knife carrier, whereas its connecting rod head surrounds the eccentric ring. Advantageously, a roller bearing is arranged between the rotating eccentric ring and the connecting rod head. Expediently, a hard metal liner is inserted into the connecting rod foot through which a hard metal bolt extends that is connected to the knife carrier.

In order to ensure that the angle of inclination of the cutting knife can be adjusted to a desired value and does not change during the cutting, advantageously, the oscillation drive can be blocked in various arbitrary and discrete pivot positions, wherein the change of the angle of inclination can be carried out either continuously or in discrete steps. In the first case, the oscillation drive can advantageously be attached to the holder in a fixed manner using a clamping device of the cutting unit, which provides for an arbitrary change of the angle of inclination.

Another preferred embodiment of the invention provides that the angle of inclination of the cutting knife can be altered even during the advancing movement of the knife across the material support surface. Advantageously, this is done with the aid of a computer-controlled actuating drive, which is expediently attached in a fixed manner to the holder and moves the oscillation drive with respect to the holder in a controlled manner around the pivot axis.

By pivoting of the oscillation drive around the pivot axis, the tip of the cutting knife does not only move in the direction of the Z-axis of the Cartesian coordinate system of the material support surface, either away from it or towards it, but also in the direction of the X-axis and, in the case of a rotation of the cutting knife around the rotary axis of the tangential or rotary drive, also moves in the direction of the Y-axis away from the desired movement path. Therefore, another advantageous embodiment of the invention provides that the device has means for compensation of these movements in the direction of the X-, Y- and Z-axes.

To compensate for the movement in the direction of the Z-axis, in the first a.m. case the holder and in the last a.m. case the tangential or rotary drive can be adjusted in height with reference to the carrier so that a change of the position of the tip of the cutting knife as a result of the pivoting movement can be compensated. Expediently, the compensation is carried out automatically as a function of the particular pivoting angle using a computer-controlled actuating drive.

On the other hand, the compensation of the movement of the tip of the cutting knife in the direction of the X- or Y-axis, which is caused by the pivoting of the oscillation drive, is achieved preferably by an appropriate control of a drive of the arch or of the carrier respectively in order to move the arch or the carrier respectively for compensation by a corresponding amount into the opposite direction.

In the following the invention will be explained in more detail with the aid of a practical example shown in the drawing.

DETAILED DESCRIPTION OF THE DISCLOSURE

Figure 1:
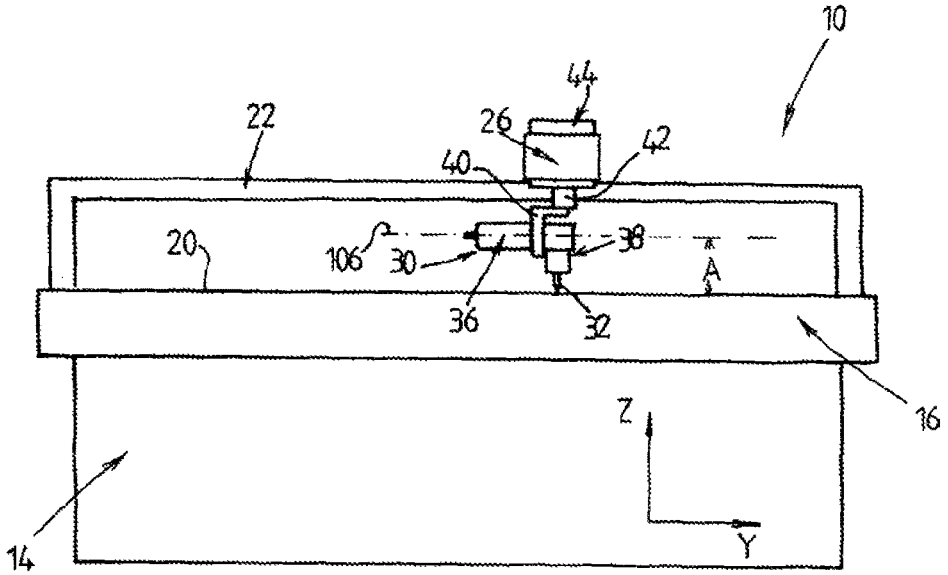
FIG. 1 shows a schematic side view of a device according to the invention having a cutting table with a material supporting surface and a cutting unit with a pivotable oscillation drive as well as a cutting knife.

The device 10 shown in the drawing serves for the processing of material 12 by cutting, especially of layered material or plate-shaped material which has at least one plane surface for laying onto a flat support and which can be cut by a cutting knife, like cardboard, cork, foamed material, polystyrene, reboard or other sandwich slabs.

Figure 2:
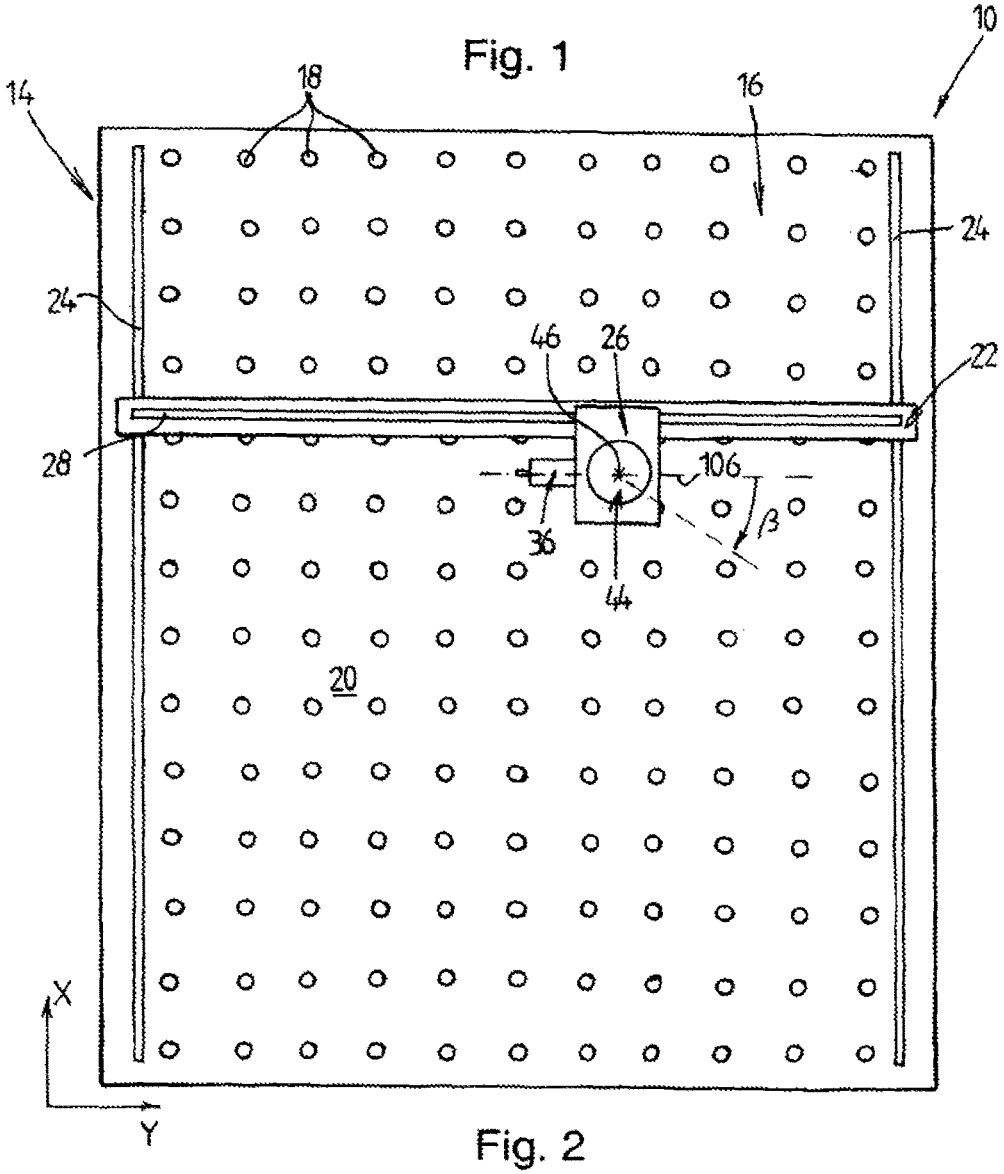
FIG. 2 shows a top view of the device from FIG. 1.

As shown best in FIGS. 1 and 2, the device 10 comprises a supporting or cutting table 14 with a table top 16, whose flat horizontal upper surface forms a material supporting surface 20 for the material to be cut 12. In order to secure the material 12 on the material supporting surface 20 while it is being cut, the table top 16 is provided with a multiple number of small through-bores 18 which communicate with a plenum (not shown) arranged on the bottom side of the table top 16 from which plenum air is aspirated in order to apply a vacuum to the bores 18.

Furthermore, the device 10 has an arch or portal 22 which extends in a vertical distance from the material supporting surface 20 across the supporting or cutting table 14 and can be moved back and forth by a controllable portal drive (not shown) on tracks 24 or other linear guides in the direction of a horizontal X-axis of a Cartesian coordinate system that is parallel to the material supporting surface 20. The arch or portal 22 supports a carrier 26 for a cutting unit 30, which can be moved back and forth by a controllable carrier drive (not shown) on tracks 28 or other linear guides in the direction of a horizontal Y-axis of the Cartesian coordinate system. The cutting unit 30 can be removed from the carrier 26 so that in case of need it can be replaced by another processing unit, for example, a milling unit or marking unit.

The cutting unit 30 comprises a cutting knife 32, a knife holder 34, a linear guide 37 for the knife holder 34, an oscillation drive 36 for driving the knife holder 34 in an oscillating manner, a cam 38 arranged between the oscillation drive 36 and the knife holder 34, a tangential or rotary drive 44 for active alignment of the cutting knife 32, and a holder 40 that connects the oscillation drive to a drive shaft 42 of the tangential or rotary drive 44.

With the aid of the oscillation drive 36 and of the cam 38, the cutting knife 32 can be set into linear oscillations, the oscillation axis 46 of which is perpendicular to the advancing direction of the cutting knife 32, that is, the direction in which the cutting knife 32 moves across the material supporting surface 20 through the material 12 to be cut. When the cutting knife 32 cuts the material 12 along a cutting plane that is perpendicular to the material supporting surface 20, as represented in FIG. 5, the oscillation axis 46 of the linear oscillations of the cutting knife 32 is also perpendicular to the material supporting surface 20 and thus coincides with a vertical Z-axis of the Cartesian coordinate system of the device 10.

Figure 5:
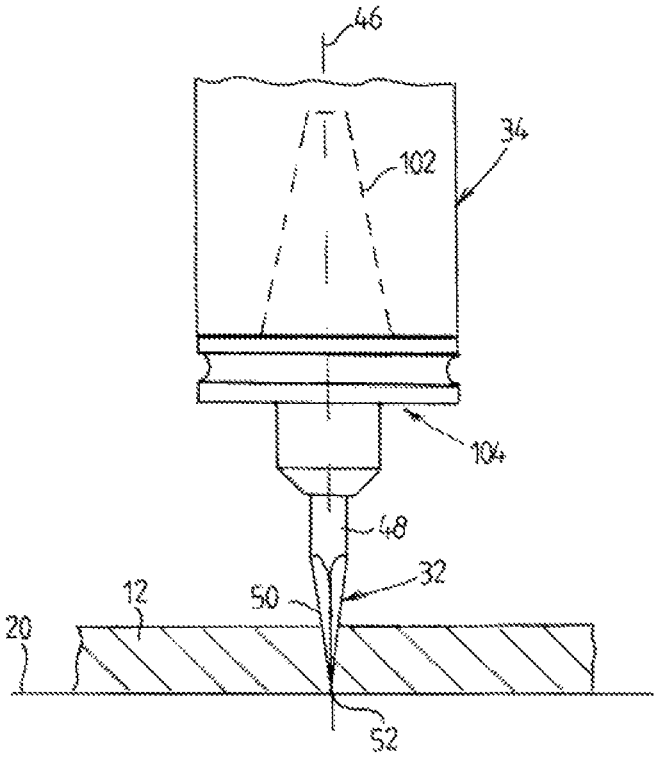
FIG. 5 shows an enlarged view of the cutting knife during the cutting of a plate-shaped material and viewed in the advancing direction, in the state according to FIG. 3.
Figure 6:
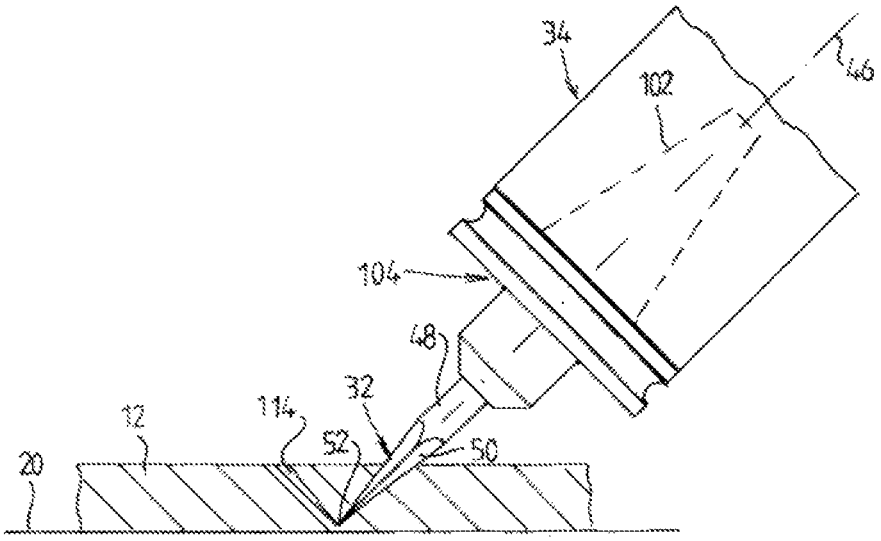
FIG. 6 shows an enlarged view of the cutting knife according to FIG. 5, but in the state according to FIG. 4.

As shown best in FIGS. 5 and 6, the cutting knife 32 has a cylindrical shaft 48 and a narrowed end section 50 which enters into the material 12 to be cut. The cutting knife has a blade or cutting edge pointing in the advancing direction and has a tip 52. The cutting knife 32 in the drawings is a tangential knife which, during the cutting of material 12 along a curved cutting line, is rotated actively or in a controlled manner around the oscillation axis 46 so that the cut is always aligned with the advancing direction of the knife or is oriented tangentially to the curved cutting line.

The oscillation drive 36 comprises an electric drive motor with a cylindrical motor housing 54 and a motor shaft 56 that is supported within the motor housing 54 in two roller bearings (not visible). The motor shaft 56 comprises two shaft ends 58, 60, each of which projects from one of the two opposite ends of the motor housing 54. The shaft end 60 on the side of the cam 38 is supported with its free end in another roller bearing 62, so that the motor shaft 56 is rotatably supported in a total of three roller bearings. The roller bearing 62 is inserted into a recess that is coaxial to the rotary axis of the motor shaft 56 the recess being arranged in a removable bearing cover 64, which is fastened tightly with set screws 66 to the adjacent end of the motor housing 54. The roller bearing 62 can be lubricated through a bore 68 in the middle of the bearing cover 64.

The cam 38 has a cam housing 70, which consists of an upper part 72 arranged in extension of the motor housing 54 and a lower part 74 that protrudes downwardly. Both parts are connected to each other to form one piece. The cam housing 70 is fastened with set screws 76 to the adjacent end of the motor housing 54. The upper part 72 of the cam housing 70 is arranged between the end of the motor housing 54 and the bearing cover 64, where it partly overlaps a lower part of the end of the motor housing 54 and abuts the holder 40 with an abutment face 77 on the motor side. The upper part 72 surrounds a stepped bore 78, which is coaxial with the motor shaft 56, which extends to the adjacent end of the motor housing 54 and which is closed on its end facing away from the motor housing 54 by the bearing cover 64. The lower part 74 of the cam housing 70 surrounds a stepped bore 80, which is open toward the bottom and which is coaxial with the oscillation axis 46. The lower part 74 opens into the stepped bore 78 within the upper part 72 and is closed at its upper end above the motor shaft 56 by a plate 82.

The cam 38 is a crank mechanism for converting the rotation of the motor shaft 56 into an oscillating movement of the knife holder 34 along the oscillation axis 46. Within the cam housing 70 the cam 38 comprises an eccentric ring 84 that is arranged on the shaft end 60 between the adjacent end of the motor housing 54 and the bearing cover 64 in extension of the oscillation axis 46. The eccentric ring 84 has an inner cylindrical surface that is concentric to the rotational axis of the motor shaft 56 and an outer cylindrical surface that is eccentric to the rotational axis of the motor shaft 56. The eccentric ring 84 is fixedly attached to the motor shaft 56 so that it rotates together with the motor shaft 56.

Furthermore, the cam 38 comprises a connecting rod 86 which is made in one piece from light metal. The connecting rod 86 has a connecting rod head 88 surrounding the eccentric ring 84 and a connecting rod foot 90 which is articulated to the knife holder 34. Between the connecting rod head 88 and the eccentric ring 84 there is a closed needle bearing or ball bearing 92, the inner ring of which is pressed onto the cylindrical outer peripheral surface of the eccentric ring 84 whereas the outer ring is pressed into an eye of the connecting rod head 88. In order to accommodate the needle bearing or ball bearing 92, the width of the connecting rod head 88 is larger than that of the rest of the connecting rod 86 and of the connecting rod foot 90 in the axial direction of the motor shaft 56, as shown best in FIG. 9. In order to prevent an axial shift of the eccentric ring 84 and/or of the needle bearing or ball bearing 92, a spacer 94 is provided on the motor shaft 56 between the eccentric ring 84 and the needle bearing or ball bearing 92 on the one hand and the roller bearing 62 on the other hand.

The knife guide 37 consists of a cylindrical tube that is open at both ends, which is coaxial to the oscillation axis 46 and is inserted from below into a widened part of the stepped bore 80 and fixedly attached.

The knife holder 34 is a hollow cylindrical piston made of light metal, which is guided within the hollow cylindrical knife guide 37 so that it can move in the direction of the oscillation axis 46, wherein its outer peripheral surface slides during the oscillation movement with a slight clearance on the inner peripheral surface of the knife guide 37. For lubrication of these sliding surfaces a transverse bore 96 is provided, which extends through a wall of the lower part 74 of the cam housing 70, a wall of the hollow cylindrical knife guide 37 and a wall of the hollow cylindrical knife holder 34.

The knife holder 34 is provided on its open upper end with a transverse bore which is perpendicular to the oscillation axis 46. A holding bolt 98 made of hard metal is pressed into the transverse bore. The bolt 98 extends through a hard metal sleeve 100 in the connecting rod foot 90 of the connecting rod 86, which protrudes from above through the hollow cylindrical knife guide 37 a little distance into the open upper end of the knife holder 34.

As shown in FIGS. 5 and 6, the knife holder 34 has on its lower end a Weldon chuck with a conical clamping surface 102. With the aid of this chuck a Weldon holder 104 equipped with the cutting knife 32 can be clamped in the knife holder 34 and aligned with respect to the oscillation axis 46.

In order to facilitate the introduction of cuts into the material 12, where the cuts have a cutting face that is inclined with respect to the material supporting surface 20 at an acute angle, for example, 45 degrees or 60 degrees, the oscillation drive 36, together with the cam 38, the knife guide 37, the knife carrier 34 and the knife 32 can be pivoted with respect to the holder 40 around a pivot axis 106 that is parallel to the material supporting surface 20. The pivot axis 106 is aligned with the rotary axis of the motor shaft 56 and is perpendicular to the oscillation axis 46 of the cutting knife 32. In order to set a desired angle of inclination of the oscillation axis 46 of the cutting knife 32, additionally the oscillation drive 36 together with the components 32, 34, 36 and 38 can be positioned at any desired angular position with respect to the holder 40.

Figure 7:
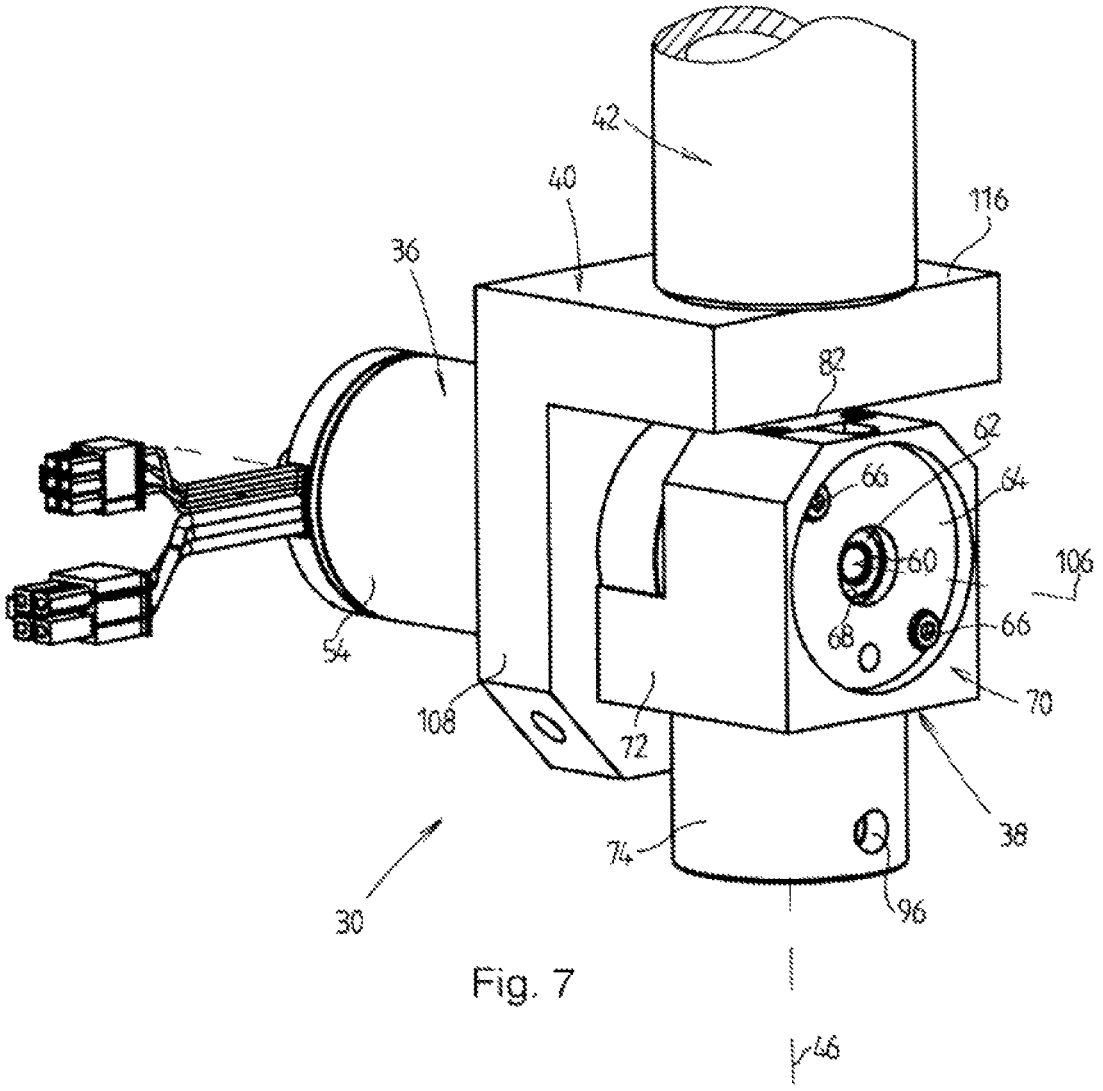
FIG. 7 shows an enlarged perspective view of parts of the cutting unit.
Figure 8:
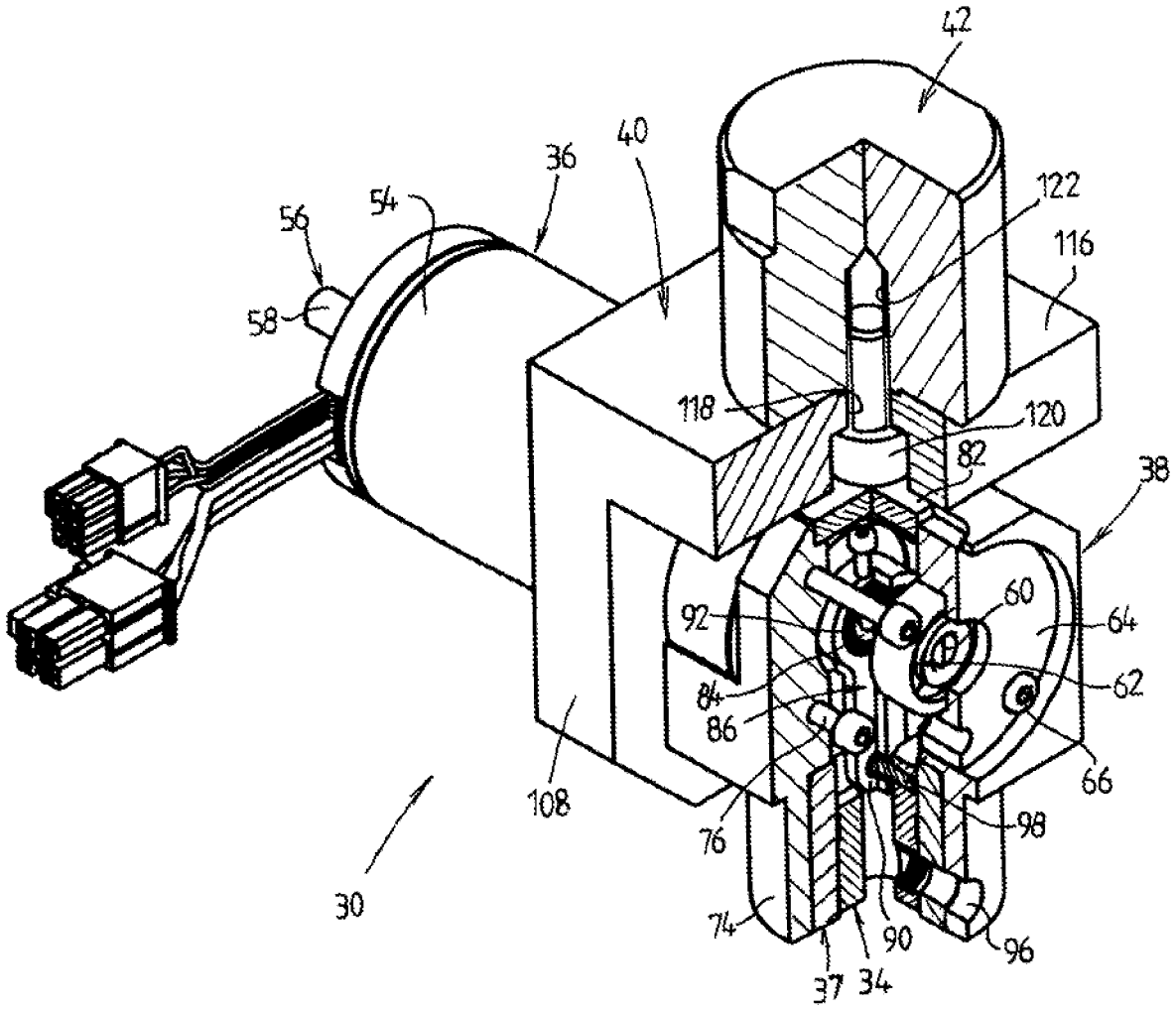
FIG. 8 shows another partially cut-away enlarged perspective view of parts of the cutting unit.
Figure 9:
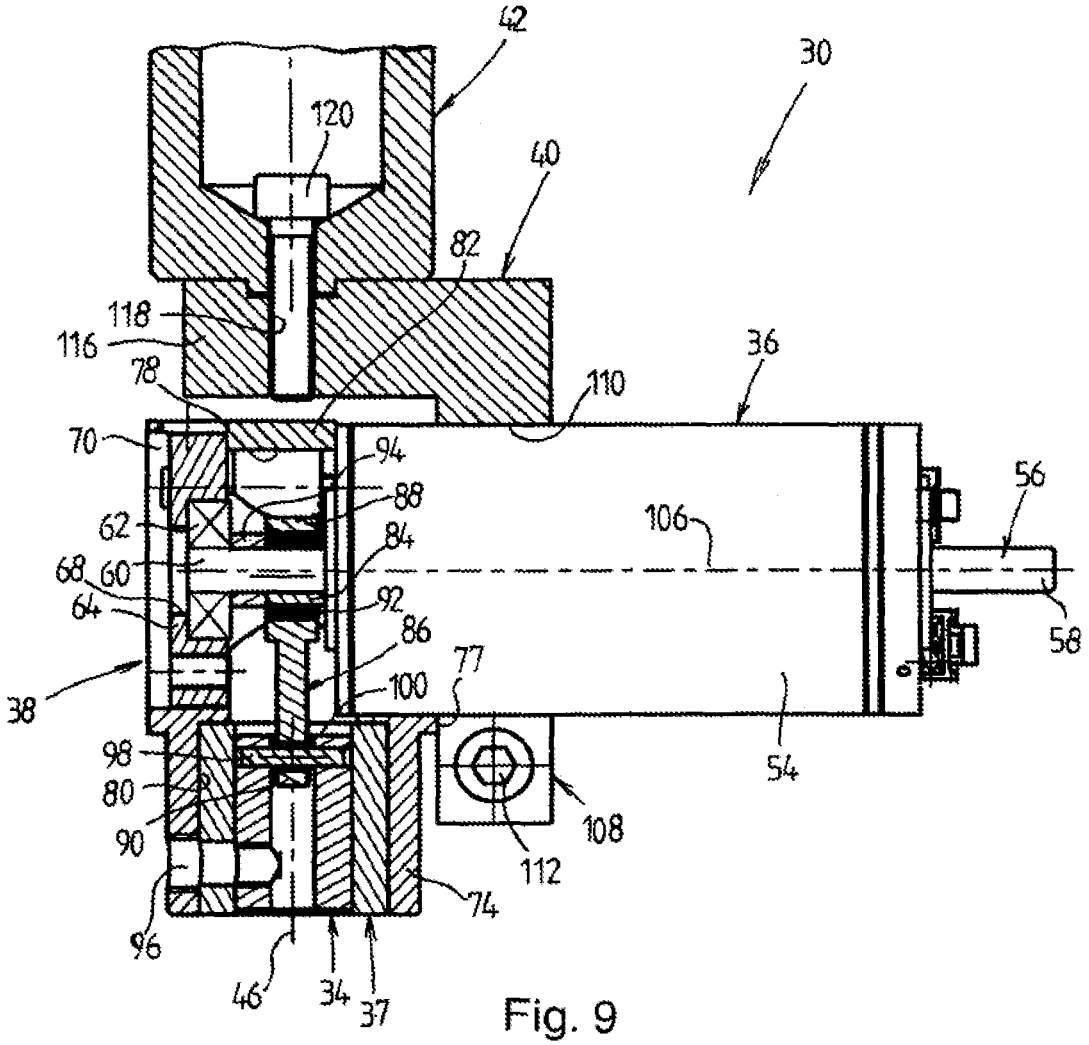
FIG. 9 shows an enlarged cut-away view of parts of the cutting unit.

In the case of the cutting unit 30 in FIGS. 7 to 9, the pivoting of the oscillation drive 36 and of the components 32, 34, 36 and 38 as well as the blocking or clamping of these components in a desired pivoting position is carried out manually. For this purpose, the holder 40, which is made in one piece, comprises a divided clamping ring 108 in which the motor housing 54 can be clamped tightly. The clamping ring 108 surrounds a through-opening 110, which has a circular cross-section and an inner diameter that is slightly larger than the outer diameter of the motor housing 54. The clamping ring 108 consists of two peripheral sections separated by a gap (which cannot be seen), the opposing ends of which sections can be pulled together with the aid of a clamping screw 112 (FIG. 9), in order to clamp a part of the cylindrical motor housing 56 of the oscillation drive 36 that is adjacent the cam 38 in the through-opening 110 in a rotational position, in which the oscillation axis 46 of the cutting knife 32 has the desired angle of inclination with respect to the material supporting surface 20. In order to mount and dismount the oscillation drive 36 in the holder 40 as well as to change the angle of inclination of the cutting knife 32, the clamping screw 112 is loosened just enough so that the motor housing 54 can be shifted in the axial direction into the through-opening 110 or pulled out from this or can be rotated around the pivot axis 106 in the through-opening 110 respectively.

Figure 10:
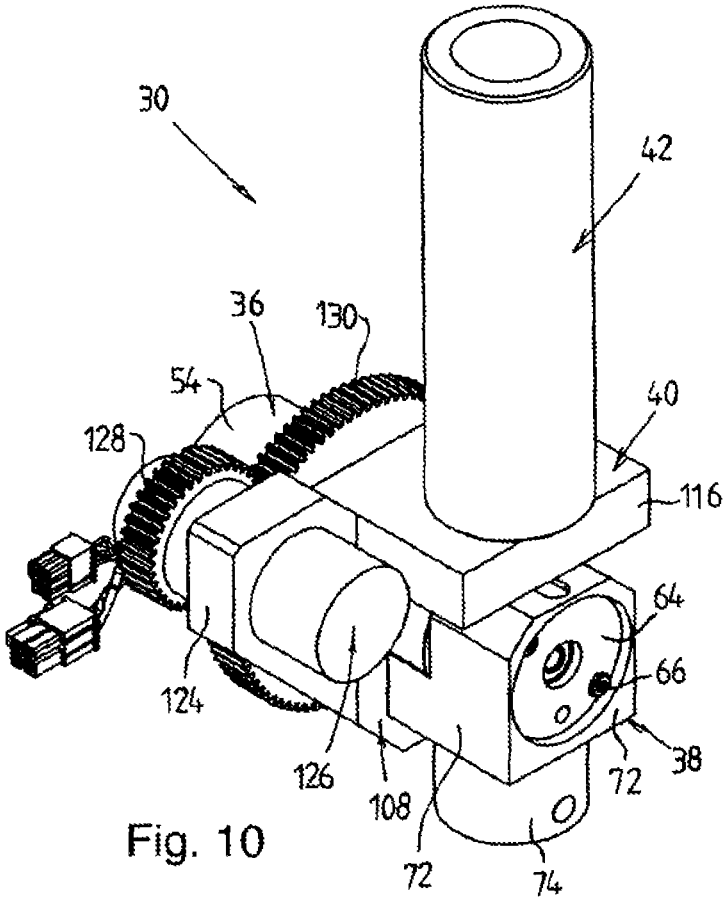
FIG. 10 shows a perspective view of parts of another somewhat modified cutting unit.
Figure 11:
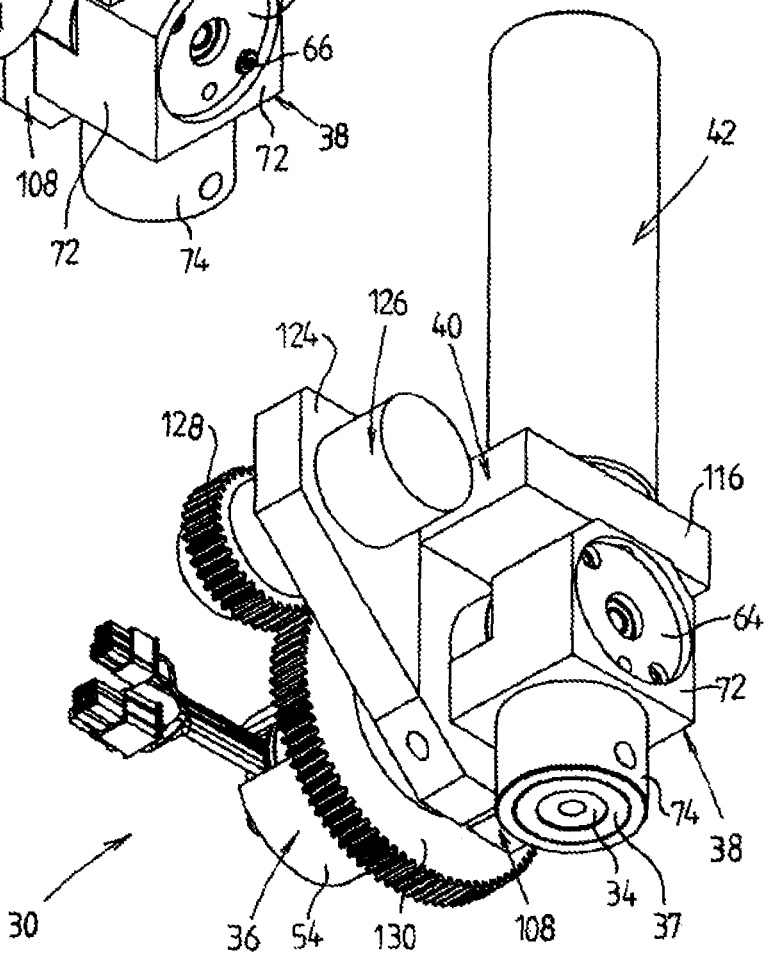
FIG. 11 shows another perspective view of the parts of the cutting unit from FIG. 10.

In the cutting unit 30 in FIGS. 10 and 11, the pivoting of the oscillation drive 36 and of the components 32, 34, 36 and 38 as well as the blocking of these components in a desired rotational position can be done with a motor.

For this purpose, the holder 40 comprises a plate-shaped projection 124 protruding sideways above the clamping ring 108 into which a step motor 126 is inserted so that it cannot rotate. The step motor 126 drives a pinion 128 which engages with a toothed-ring 130. The toothed ring is attached to the motor housing 54 so that it cannot rotate with respect to the motor housing 54 and is coaxial with the pivot axis 106. In order to set a desired angle of inclination of the oscillation axis 46, the step motor 26 can be driven in a controlled manner after the set screw 112 has been loosened in order to rotate the motor housing 54 in the through-opening 110 until the desired angle of inclination is reached.

When the angle of inclination of the cutting knife 32 is to be altered during a cutting operation, the clamping ring 108 remains loosened in order to be able to rotate the motor housing 54 by means of the step motor 126. On the other hand, when the cutting is to be performed with a constant angle of inclination, the set screw 112 is preferably tightened in order to reduce vibrations.

Fundamentally, the oscillation drive 36 can be turned through 360° in the through-opening 110 of the clamping ring 118 with respect to the holder 40; however, for the processing of the material 12 on the supporting surface 20, generally it is sufficient when the cutting knife 32, starting out from the state in FIG. 5, in which its oscillation axis 46 is perpendicular to the material supporting surface 20, can be turned through 45° to 60° in the clockwise and counter-clockwise directions.

As a result of the pivotability of the oscillation drive 36 and of the cam 38 with respect to the holder 40, it becomes possible to provide a plate-shaped material 12 resting on the material supporting surface 20, for example, a reboard plate or a cardboard piece, with cuts 114, which are inclined with respect to the material supporting surface 20, as shown in FIG. 6. In the advancing direction of the cutting knife 32, the cuts 114 can have either a straight or curved form, so that, in the latter case, for example, a part of a truncated cone shape can be cut out from the plate-shaped material 12.

When two cuts 114 with opposite inclinations are made into the plate-shaped material 12, such that the lower ends of the cuts 114 come into contact somewhat above than the supporting surface 20, a groove that is open towards the top and has a V-shaped cross section can be cut out of the material 12. When the groove is straight, it is possible to tilt the parts of the plate-shaped material 12 around the base of the groove, until the surfaces of the groove abut each other. After that the two parts are inclined with respect to each other at an angle that corresponds to the opening angle of the groove cross section.

As shown best in FIGS. 7 to 11, the holder 40 has a plate-like projecting part 116, which projects above the uppermost part of the clamping ring 108 in parallel to the motor shaft 56. The projecting part 116 extends at a distance above the cam 38, so that it does not hinder the pivoting of the cam 38 around the pivot axis 106. The projecting part 116 is provided with a through-bore 118 that is coaxial with the oscillation axis of cutting knife 32 and serves for receiving a fastening screw 120. With the fastening screw 120, the holder 40 can be fixed to the drive shaft 42 of the tangential or rotary drive 44, so that the holder 40, together with the oscillation drive 36, the cam 38 and the tangential knife 32 can be turned by the tangential or rotary drive 44 under control of a computer around the oscillation axis 46, in order to actively orient the cutting edge 52 of the cutting knife 32 into the advancing direction.

The holder 40 can be screwed onto the drive shaft 42 from below, as shown in FIG. 8, or from above, as shown in FIG. 9. In the former case, the through-bore 118 has a lower part that has a larger diameter to hold the head of the fastening screw 120 and an upper part with a smaller diameter for holding the shaft of the fastening screw 120, which is screwed with its outer thread into an axial blind bore 122 of the drive shaft 42. In the latter case, the through-bore 118 of the plate-like projection 116 is provided with an inner thread, into which the outer thread of the fastening screw 120 is screwed through an axial through-bore in the closed end of the hollow drive shaft 42.

When the oscillation drive 36 is pivoted together with the cam 38, the knife holder 34 and the cutting knife 32 around the pivot axis 106, the distance between the tip 52 of the cutting knife 32 and the material supporting surface 20 will change. Furthermore, due the pivoting of the oscillation drive 36 and of the components 32, 34, 36 and 38 the tip 52 of the cutting knife 32 will deviate from the programmed movement path, which the tip 52 would follow in case of a vertical alignment of the oscillation axis 46 during the movement of the portal 22 and/or of the carrier 26, when viewed in a vertical projection.

Figure 3:
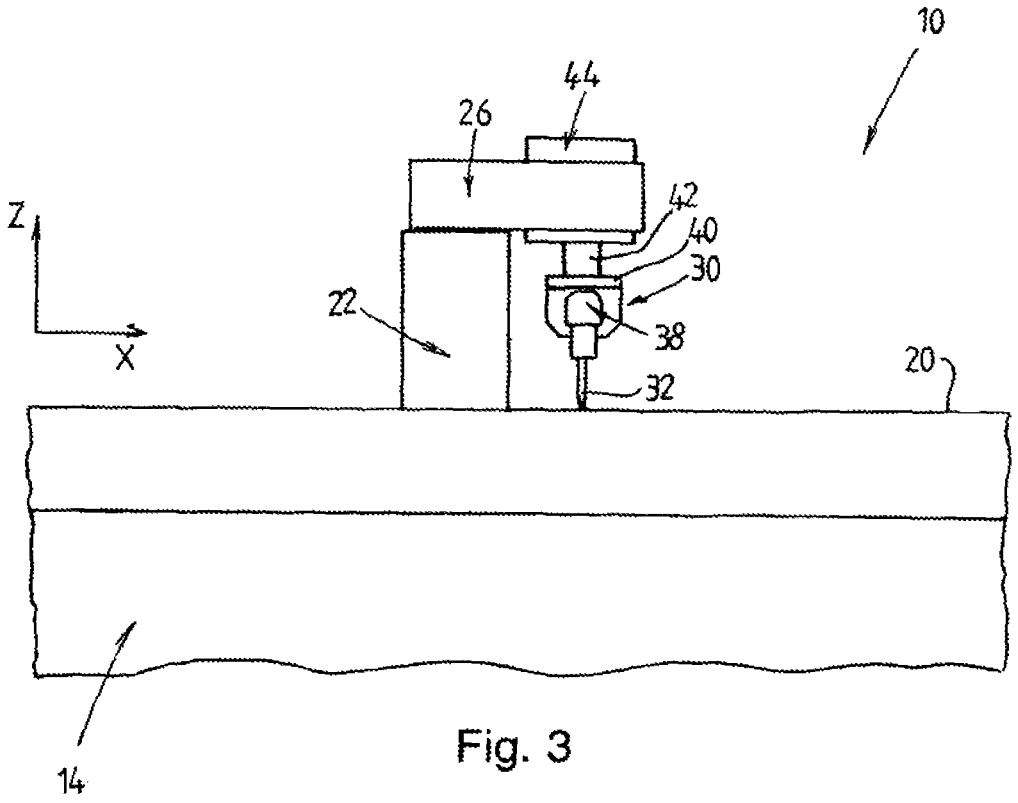
FIG. 3 shows a slightly enlarged and partially cut-away side view of the device in the direction of the arrows III in FIG. 2 in a state in which the cutting knife is oriented perpendicularly to the material supporting surface.
Figure 4:
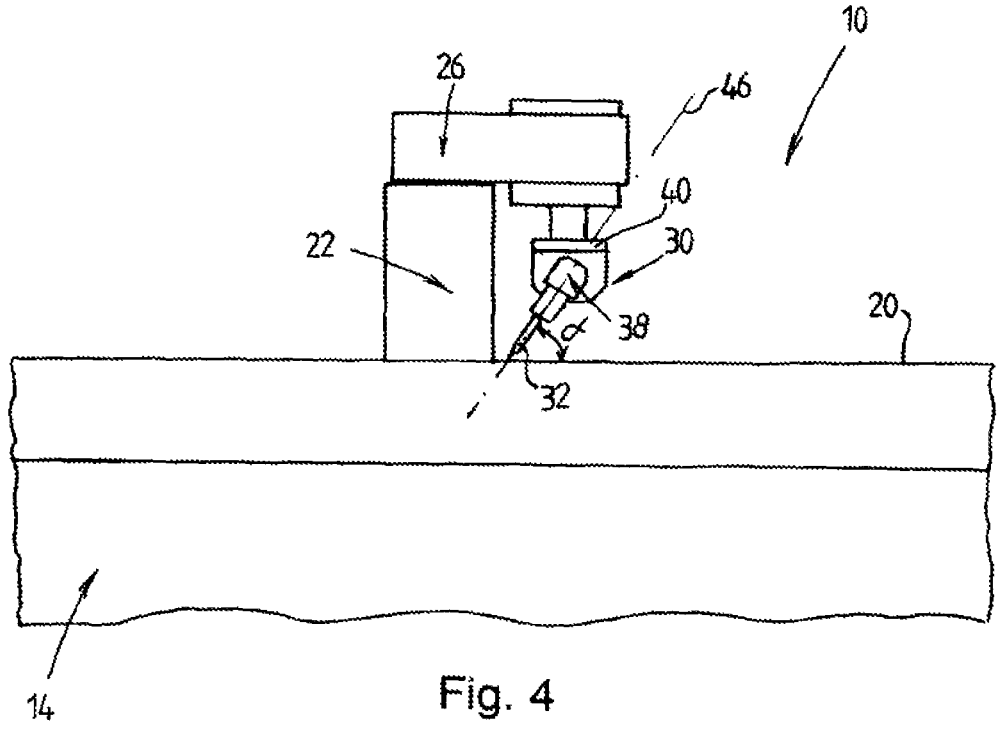
FIG. 4 shows a view according FIG. 3, but in a state in which the cutting knife is inclined at an acute angle to the material supporting surface.

For compensating the change of the vertical distance of the tip 52 of the cutting knife 32 from the material supporting surface 20, the level or height of the tangential or rotary drive 44 on the carrier 26 is adjustable, so that the drive 44 can be raised or lowered when there is a change of the pivot position of the cutting knife 32, as shown in FIGS. 3 and 4. Depending on whether the oscillation drive 36 is pivoted manually or with a motor, this setting is also carried out manually or with a motor respectively. The degree of compensation in the direction of the Z-axis is $$K(z)=A\times(1-\cos\alpha)$$

where A is the vertical distance of the pivot axis 106 from the material supporting surface 20 and where $\alpha$ is the angle of inclination of the oscillation axis 46 of the cutting knife 32 with respect to its initial vertical position, as shown in FIG. 4.

In order to compensate for the deviations of the tip 52 of the cutting knife 32 from the programmed movement path in the direction of the X- or Y-axis respectively, during a pivoting movement of the oscillation drive 36 around the pivot axis 106, the portal drive and/or the carrier drive are activated in order to move the portal 22 and/or the carrier 26 along the X-axis or Y-axis respectively in the opposite direction, where the movement of the portal 22 and/or the carrier 26 corresponds to the deviation. Here the degree of compensation in the direction of the X-axis, that is, the movement required of the portal 22 in the X-direction with respect to the cutting table 14, is:

$$K(x)=A\times\sin\alpha\times\cos\beta.$$

The degree of compensation in the direction of the Y-axis, that is, the movement of the carrier 26 in the Y-direction with respect to the cutting table 14, which is necessary for the compensation, is:

$$K(y)=A\times\sin\alpha\times\sin\beta,$$

where A is the vertical distance of the pivot axis 106 from the material supporting surface 20, where $\alpha$ is the angle of inclination of the oscillation axis 46 of the cutting knife 32 with respect to its initial vertical position, as shown in FIG. 4, and where $\beta$ is the angle of rotation of the drive shaft 42 of the tangential or rotary drive 44, and thus the angle of rotation of the components 32, 36, 38 in a plane that is parallel to the material supporting surface 20, with respect to an initial position (FIG. 2), in which the motor shaft 56 and the pivot axis 106 are parallel to the portal 22.

With the device 10 described above, the cutting knife 32 can be driven with an oscillation frequency of 18,000 oscillations per minute and an exact piston or knife stroke of 1.6 mm. In comparison to a pneumatic cutting unit, the cut has an adjustable, constant cutting depth.

The oscillation frequency can be altered, since an rpm-controlled motor is used as the electric motor, while the piston stroke can be altered by replacing the eccentric ring 84 by another eccentric ring 84 with a larger or smaller eccentricity.

Although certain cutting devices and cutting units and features and characteristics thereof have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A device for the cutting of material on a plane material supporting surface, the device having the plane material supporting surface and at least one cutting unit, wherein the at least one cutting unit can be motor-driven in a controlled manner above and across the material supporting surface in a direction of an X- and Y-axis of a Cartesian coordinate system that is parallel to the material supporting surface, wherein the at least one cutting unit is mounted on a carrier and wherein the carrier is controllably movable in the direction of the X-axis and Y-axis of the Cartesian coordinate system, wherein the at least one cutting unit comprises an oscillation drive and a cutting knife, wherein the oscillation drive sets the cutting knife into linear oscillations having an oscillation axis that is perpendicular to an advancing direction of the cutting knife, wherein for changing an angle of inclination of the oscillation axis with respect to the material supporting surface the oscillation drive with the cutting knife is pivotable around a pivot axis that is parallel to the material supporting surface, wherein the oscillation drive comprises an electric motor having a rotary drive shaft that is parallel to the material supporting surface, wherein the rotary axis of the rotary drive shaft is aligned with the pivot axis, wherein the cutting unit comprises a linearly guided knife holder and further comprises a cam between the rotary drive shaft of the oscillation drive and the knife holder, wherein the cam converts the rotation of the rotary drive shaft into an oscillating movement of the knife holder along the oscillation axis, wherein the cam comprises an eccentric ring, wherein the eccentric ring is fixedly connected to the rotary drive shaft, and wherein the eccentric ring has an inner cylindrical surface that is concentric to the rotary axis of the rotary drive shaft and has an outer surface cylindrical surface that is eccentric to the rotary axis of the rotary drive shaft.

2. The device according to claim 1, wherein the pivot axis and the rotary axis of the rotary drive shaft are perpendicular to the oscillation axis of the cutting knife and intersect the oscillation axis.

3. The device according to claim 1, wherein the electric motor of the oscillation drive has a motor housing, and wherein the rotary drive shaft projects from the motor housing and is supported in two bearings within the motor housing and in a further bearing outside of the motor housing beyond the oscillation axis.

4. The device according to claim 1, wherein the carrier is mounted to an arch or portal, wherein the arch or portal is controllably movable in the X-direction with respect to the material supporting surface and wherein the carrier is controllably movable in the Y-direction with respect to the arch or portal.

5. The device according to claim 1, wherein the at least one cutting unit comprises a holder for the oscillation drive, wherein the holder is attached to the carrier, and wherein the oscillation drive is pivotable around the rotary axis of the rotary drive shaft with respect to the holder.

6. The device according to claim 1, wherein the at least one cutting unit comprises a controlled tangential or rotary drive for active alignment of the cutting knife and wherein the controlled tangential or rotary drive is arranged between the oscillation drive and the carrier.

7. The device according to claim 6, wherein the at least one cutting unit comprises a holder for the oscillation drive, wherein the holder is attached to a drive shaft of the tangential or rotary drive, and wherein the oscillation drive is pivotable around the rotary axis of the rotary drive shaft with respect to the holder.

8. The device according to claim 6, further comprising means for compensating movements of the cutting knife in a direction of the Z-axis of the Cartesian coordinate system, that are caused by pivoting movements of the oscillation drive around the pivot axis, wherein the means for compensating comprise means for adjusting a level or height of the tangential or rotary drive and wherein the compensating movements in the direction of the Z-axis for adjusting the level or height of the tangential or rotary drive are equal to $$K(z)=A\times(1-\cos\alpha)$$

where A is the distance of the pivot axis from the material supporting surface in the direction of the Z-axis and where $\alpha$ is the angle of inclination of the oscillation axis of the cutting knife with respect to the Z-axis.

9. The device according to claim 6, further comprising means for compensating movements of the cutting knife in a direction of the X-axis of the Cartesian coordinate system, that are caused by pivoting movements of the oscillation drive around the pivot axis, wherein the means for compensating comprise means for moving the arch or portal along the X-axis in an opposite direction, wherein the compensating movements in the direction of the X-axis are equal to $$K(x)=A\times\sin\alpha\times\cos\beta$$

where A is the distance of the pivot axis from the material supporting surface in the direction of the Z-axis, where $\alpha$ is the angle of inclination of the oscillation axis of the cutting knife with respect to the Z-axis and where $\beta$ is the angle of rotation of a drive shaft of the tangential or rotary drive with respect to an initial position.

10. The device according to claim 6, further comprising means for compensating movements of the cutting knife in a direction of the Y-axis of the Cartesian coordinate system, that are caused by pivoting movements of the oscillation drive around the pivot axis, wherein the means for compensating comprise means for moving the carrier along the Y-axis in an opposite direction, wherein the compensating movements in the direction of the Y-axis are equal to $$K(y)=A\times\sin\alpha\times\sin\beta$$

where A is the distance of the pivot axis from the material supporting surface in the direction of the Z-axis, where $\alpha$ is the angle of inclination of the oscillation axis of the cutting knife with respect to the Z-axis and where $\beta$ is the angle of rotation of a drive shaft of the tangential or rotary drive with respect to an initial position.

11. A cutting unit, comprising an oscillation drive, a holder for the oscillation drive, a carrier for the holder and a cutting knife, wherein the oscillation drive sets the cutting knife into linear oscillations having an oscillation axis, which is perpendicular to an advancing direction of the cutting knife, wherein the oscillation drive with the cutting knife is pivotable with respect to the holder around a pivot axis that is perpendicular to the oscillation axis, wherein the oscillation drive comprises an electric motor having a rotary drive shaft and wherein the rotary axis of the rotary drive shaft is aligned with the pivot axis and intersects the oscillation axis, wherein the cutting unit comprises a linearly guided knife holder and further comprises a cam between the rotary drive shaft of the oscillation drive and the knife holder, wherein the cam converts the rotation of the rotary drive shaft into an oscillating movement of the knife holder along the oscillation axis, wherein the cam comprises an eccentric ring, wherein the eccentric ring is fixedly connected to the rotary drive shaft and wherein the eccentric ring has an inner cylindrical surface that is concentric to the rotary axis of the rotary drive shaft and has an outer surface cylindrical surface that is eccentric to the rotary axis of the rotary drive shaft.

12. The cutting unit according to claim 11, wherein the electric motor of the oscillation drive has a motor housing, and wherein the rotary drive shaft projects from the motor housing and is supported in two bearings within the motor housing and in a further bearing outside of the motor housing beyond the oscillation axis.

13. The cutting unit according to claim 11, further comprising a controlled tangential or rotary drive for active alignment of the cutting knife.

14. The cutting unit according to claim 13, further comprising:

a holder for the oscillation drive, wherein the holder is attached to a drive shaft of the tangential or rotary drive, and wherein the oscillation drive is pivotable around the rotary axis of the rotary drive shaft with respect to the holder; and a clamping ring for clamping the oscillation drive in various angular positions with respect to the holder.

* * * * *